US010996585B2

(12) United States Patent
Shimizu et al.

(10) Patent No.: US 10,996,585 B2
(45) Date of Patent: May 4, 2021

(54) IMAGE FORMING APPARATUS

(71) Applicant: KYOCERA Document Solutions Inc., Osaka (JP)

(72) Inventors: Tamotsu Shimizu, Osaka (JP); Mitsuhiro Hashimoto, Osaka (JP); Takahiro Okubo, Osaka (JP); Kazuhiro Nakachi, Osaka (JP); Shiro Kaneko, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/985,151

(22) Filed: Aug. 4, 2020

(65) Prior Publication Data

US 2021/0041802 A1 Feb. 11, 2021

(30) Foreign Application Priority Data

Aug. 9, 2019 (JP) ..... JP2019-147683

(51) Int. Cl.
*G03G 15/06* (2006.01)
*G03G 15/08* (2006.01)

(52) U.S. Cl.
CPC ..... *G03G 15/065* (2013.01); *G03G 15/0849* (2013.01)

(58) Field of Classification Search
CPC ..... G03G 15/0266; G03G 15/065; G03G 15/0849; G03G 15/0907; G03G 2215/0607
USPC ..... 399/38, 53, 265, 279, 285
See application file for complete search history.

(56) References Cited

U.S. PATENT DOCUMENTS 7,343,122 B2 * 3/2008 Itagaki ..... G03G 15/065 399/267
9,026,011 B2 * 5/2015 Kubo ..... G03G 15/0849 399/269
9,229,356 B2 * 1/2016 Matsui ..... G03G 15/0266

FOREIGN PATENT DOCUMENTS

JP 2007-322716 A 12/2007

* cited by examiner

*Primary Examiner* — Hoan H Tran
(74) *Attorney, Agent, or Firm* — Stein IP, LLC

(57) ABSTRACT

An image forming apparatus includes an image forming portion, a high-voltage generation circuit, a current detection portion and a control portion. The image forming portion includes an image carrying member, a charging device, an exposure device and a developing device which includes a developer carrying member for carrying a developer including a carrier and a toner. The control portion can perform a development ghost prediction mode that includes a step of measuring the amount of charge of the toner within the developing device at the time of non-image formation, a step of measuring, as a carrier current, the direct-current component of a development current when the amount of development of the toner is 0 [mg/cm$^2$] and a step of estimating the level of occurrence of development ghost and the cause of occurrence based on the amount of charge of the toner and the carrier current which are measured.

9 Claims, 6 Drawing Sheets

IMAGE FORMING APPARATUS

INCORPORATION BY REFERENCE

This application is based upon and claims the benefit of priority from the corresponding Japanese Patent Application No. 2019-147683 filed on Aug. 9, 2019, the entire contents of which are incorporated herein by reference.

BACKGROUND

The present disclosure relates to image forming apparatuses, such as a copying machine, a printer, a facsimile machine and a multifunctional peripheral thereof, which include an image carrying member, and particularly relates to a method of reducing development ghost in which after a developer carrying member is rotated one revolution, an immediately previous image appears on an image.

In an image forming apparatus using an electrophotographic process, the following process is generally performed, a photosensitive layer on the surface of a photosensitive drum (image carrying member) is charged with a charging device so as to have a predetermined surface potential (the same polarity as the charging polarity of a toner), and thereafter an electrostatic latent image is formed on the photosensitive drum with an exposure device. Then, the formed electrostatic latent image is visualized with a toner within a developing device. Furthermore, the following process is generally performed, and specifically, the toner image thereof is transferred on a recording medium which is passed through a nip portion (transfer nip portion) between the photosensitive drum and a transfer member that makes contact with the photosensitive drum, and thereafter fixing processing is performed.

Disadvantageously, in an image forming apparatus of a two-component development type which uses a two-component developer including a carrier and a toner, when an electrostatic latent image is developed on a photosensitive drum, after a developing roller is rotated one revolution, an immediately previous image pattern appears on an output image. This is called development ghost (development history).

This development ghost occurs due to a reason as described below. In a development region in which a developing roller and the photosensitive drum are opposite each other, the toner is moved from the developing roller to the photosensitive drum in the image (solid) portion of an image pattern. By contrast, in a white background portion, the toner is moved from the photosensitive drum to the developing roller. Hence, on the developing roller, a toner layer in a place corresponding to the white background portion of the image pattern has a larger thickness than the image portion. Although in general, in the two-component development type, the developer carried on the developing roller is separated from the developing roller after the completion of development, it is difficult to completely separate the developer.

When a portion where a previous image pattern was developed enters the development region again by the rotation of the developing roller, in a part where the toner layer is thick (the previous white background portion), the toner layer serves as a resistance layer, and thus a change in which a development voltage is shifted or the like is made, with the result that a phenomenon occurs in which as compared with a part where the toner layer is thin (the previous image portion), an image density is increased at the time of the subsequent round of development. This difference in the image density is the development ghost. Since the development ghost easily occurs when the amount of charge of the toner is lowered and the development ghost is worsened when Vpp of the alternating-current component of the development voltage is increased, when it is predicted that the amount of charge of the toner is lowered in a high temperature and high humidity environment or the like, it is possible to reduce the development ghost by lowering Vpp of the development voltage.

For example, an image forming apparatus configured as described below is known; in a development type in which a two-component developer is carried on the surface of a developer carrying member, in which only a toner is moved from the two-component developer on the surface of the developer carrying member to the surface of a toner carrying member so as to form a toner layer on the surface of the toner carrying member and in which the toner is flown from the toner layer to the surface of an electrostatic latent image carrying member where an electrostatic latent image is formed so as to develop the electrostatic latent image, a control mechanism is provided that decreases a difference between the density of an image (first patch) formed in the first revolution of the toner carrying member and the density of an image (second patch) formed in the second revolution thereof.

SUMMARY

An image forming apparatus according to one aspect of the present disclosure includes an image forming portion, a high-voltage generation circuit, a current detection portion and a control portion. The image forming portion includes an image carrying member in which a photosensitive layer is formed on a surface, a charging device which charges the image carrying member, an exposure device which exposes the image carrying member charged with the charging device so as to form an electrostatic latent image and a developing device which includes a developer carrying member that is arranged opposite the image carrying member and that carries a developer including a magnetic carrier and a toner and which adheres the toner to the electrostatic latent image formed on the image carrying member so as to form a toner image. The high-voltage generation circuit applies, to the developer carrying member, a development voltage in which an alternating-current voltage is superimposed on a direct-current voltage. The current detection portion detects a direct-current component of a development current which flows when the development voltage is applied to the developer carrying member. The control portion controls the image forming portion and the high-voltage generation circuit. The control portion can perform a development ghost prediction mode that includes a step of measuring the amount of charge of the toner within the developing device at the time of non-image formation, a step of measuring, as a carrier current, the direct-current component of the development current when the amount of development of the toner is 0 [mg/cm$^2$] and a step of estimating the level of occurrence of development ghost and the cause of occurrence thereof based on the amount of charge of the toner and the carrier current which are measured.

Further other objects of the present disclosure and specific advantages obtained by the present disclosure will become more apparent from the description of an embodiment given below.

DETAILED DESCRIPTION

Figure 1:
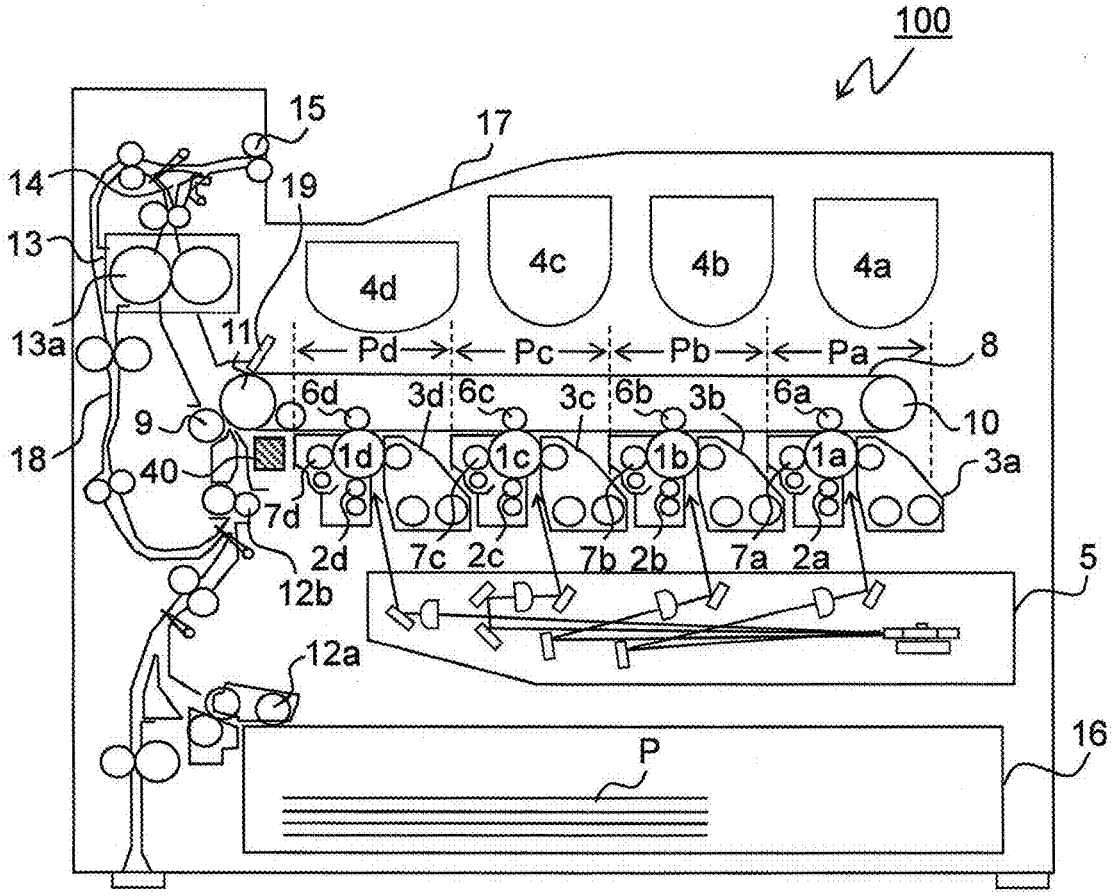
FIG. 1 is a side cross-sectional view showing an internal configuration of an image forming apparatus according to an embodiment of the present invention.

An embodiment of the present invention will be described below with reference to drawings. FIG. 1 is a cross-sectional view showing an internal structure of an image forming apparatus 100 according to an embodiment of the present invention. Within the main body of the image forming apparatus 100 (here, a color printer), four image forming portions Pa, Pb, Pc and Pd are arranged sequentially from an upstream side in a conveying direction (right side in FIG. 1). These image forming portions Pa to Pd are provided so as to correspond to images of four different colors (cyan, magenta, yellow and black), and the images of cyan, magenta, yellow and black are sequentially formed in the individual steps of charging, exposure, developing and transfer.

In these image forming portions Pa to Pd, photosensitive drums (image carrying members) 1*a*, 1*b*, 1*c* and 1*d* are arranged which carry visible images (toner images) of the individual colors. Furthermore, an intermediate transfer belt (intermediate transfer member) 8 which is rotated in the clockwise direction of FIG. 1 with a drive means (not shown) is provided adjacent to the image forming portions Pa to Pd. The toner images formed on these photosensitive drums 1*a* to 1*d* are sequentially primarily transferred on the intermediate transfer belt 8 which is moved while making contact with the photosensitive drums 1*a* to 1*d* so as to be superimposed on each other. Thereafter, the toner images primarily transferred on the intermediate transfer belt 8 are secondarily transferred with a secondary transfer roller 9 on transfer paper P which is an example of a recording medium. Furthermore, the transfer paper P on which the toner images are secondarily transferred is ejected from the main body of the image forming apparatus 100 after the toner images are fixed in a fixing portion 13. While the photosensitive drums 1*a* to 1*d* are being rotated in the counterclockwise direction of FIG. 1, an image formation process is performed on the individual photosensitive drums 1*a* to 1*d*.

The transfer paper P on which the toner images are secondarily transferred is stored within a sheet cassette 16 which is arranged in a lower portion of the main body of the image forming apparatus 100. The transfer paper P is conveyed through a paper feed roller 12*a* and a registration roller pair 12*b* to a nip portion between the secondary transfer roller 9 and a drive roller 11 for the intermediate transfer belt 8. As the intermediate transfer belt 8, a sheet which is formed of a dielectric resin is used, and a (seamless) belt which has no seam is mainly used. On the downstream side of the secondary transfer roller 9, a blade-shaped belt cleaner 19 is arranged which removes the toners and the like left on the surface of the intermediate transfer belt 8.

The image forming portions Pa to Pd will then be described. Around and below the photosensitive drums 1*a* to 1*d* which are rotatably arranged, charging devices 2*a*, 2*b*, 2*c* and 2*d* which charge the photosensitive drums 1*a* to 1*d*, an exposure device 5 which exposes the photosensitive drums 1*a* to 1*d* based on image information, developing devices 3*a*, 3*b*, 3*c* and 3*d* which form the toner images on the photosensitive drums 1*a* to 1*d* and cleaning devices 7*a*, 7*b*, 7*c* and 7*d* which remove developers (toners) and the like left on the photosensitive drums 1*a* to 1*d* are provided.

When image data is input from a host device such as a personal computer, the charging devices 2*a* to 2*d* first uniformly charge the surfaces of the photosensitive drums 1*a* to 1*d*. Then, the exposure device 5 applies light according to the image data so as to form electrostatic latent images corresponding to the image data on the photosensitive drums 1*a* to 1*d*. Predetermined amounts of two-component developers which include the toners of the individual colors of cyan, magenta, yellow and black are respectively charged into the developing devices 3*a* to 3*d*. When the proportions of the toners in the two-component developers charged within the developing devices 3*a* to 3*d* fall below specified values by the formation of the toner images which will be described later, the developing devices 3*a* to 3*d* are replenished with the toners from toner containers 4*a* to 4*d*. The toners in the developers are supplied with the developing devices 3*a* to 3*d* on the photosensitive drums 1*a* to 1*d* and are electrostatically adhered so as to form the toner images corresponding to the electrostatic latent images formed by the exposure of the exposure device 5.

Then, with primary transfer rollers 6*a* to 6*d*, electric fields are provided between the primary transfer rollers 6*a* to 6*d* and the photosensitive drums 1*a* to 1*d* with a predetermined transfer voltage, and thus the toner images of cyan, magenta, yellow and black on the photosensitive drums 1*a* to 1*d* are primarily transferred on the intermediate transfer belt 8. These images of the four colors are formed so as to have a previously determined positional relationship for the formation of a predetermined full-color image. Thereafter, in order to prepare for the formation of new electrostatic latent images which will be continuously performed, the toners and the like left on the surfaces of the photosensitive drums 1*a* to 1*d* are removed with the cleaning devices 7*a* to 7*d* after the primary transfer.

The intermediate transfer belt 8 is placed over a driven roller 10 on the upstream side and the drive roller 11 on the downstream side. When the clockwise rotation of the intermediate transfer belt 8 is started by the rotation of the drive roller 11 with a drive motor (not shown), the transfer paper P is conveyed from the registration roller pair 12*b* with predetermined timing to the nip portion (secondary transfer nip portion) between the drive roller 11 and the secondary transfer roller 9 provided adjacent thereto, and thus the full-color image on the intermediate transfer belt 8 is secondarily transferred on the transfer paper P. The transfer paper P on which the toner images are secondarily transferred is conveyed to the fixing portion 13.

The transfer paper P conveyed to the fixing portion 13 is heated and pressurized with a fixing roller pair 13*a*, and thus the toner images are fixed on the surface of the transfer paper P, with the result that the predetermined full-color image is formed. In the transfer paper P on which the full-color image is formed, the conveying direction thereof is switched with a branch portion 14 that is branched in a plurality of directions, and thus the transfer paper P is ejected with an ejection roller pair 15 to an ejection tray 17 without being processed (or after being fed to a double-sided conveying path 18 where both the sides thereof are printed).

Furthermore, an image density sensor 40 is arranged in a position opposite the drive roller 11 through the intermediate transfer belt 8. As the image density sensor 40, an optical sensor is generally used which includes a light emitting element formed with an LED or the like and a light receiving element formed with a photodiode or the like. When the amount of toner adhered on the intermediate transfer belt 8 is measured, measurement light is applied from the light emitting element to individual reference images formed on the intermediate transfer belt 8, and thus the measurement light enters the light receiving element as light which is reflected off the toner and light which is reflected off the surface of the belt.

The light reflected from the toner and the surface of the belt includes specular light and diffuse light. The specular light and the diffuse light are separated with a polarization separation prism, and thereafter respectively enter separate light emitting elements. The individual light emitting elements perform photoelectric conversion on the specular light and the diffuse light which are received, and output output signals to a main control portion 80 (see FIG. 3). Then, the amount of toner is detected from changes in the characteristics of the output signals of the specular light and the diffuse light, a comparison is made with a previously determined reference density and the characteristic value of a development voltage or the like is adjusted, with the result a density correction (calibration) is performed on each of the colors.

Figure 2:
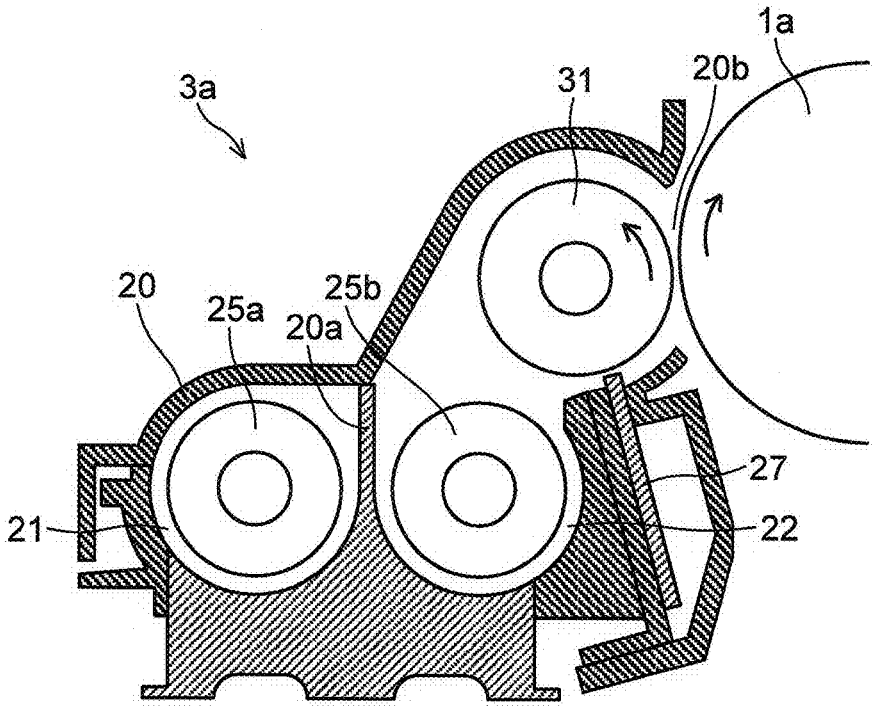
FIG. 2 is a side cross-sectional view of a developing device incorporated in the image forming apparatus.

FIG. 2 is a side cross-sectional view of the developing device 3*a* incorporated in the image forming apparatus 100. FIG. 2 shows a state which is seen from the back side of the plane of FIG. 1, and the arrangement of individual members within the developing device 3*a* are opposite to those in FIG. 1 in a lateral direction. Although in the following description, the developing device 3*a* arranged in the image forming portion Pa of FIG. 1 is illustrated, the same is basically true for the configurations of the developing devices 3*b* to 3*d* arranged in the image forming portions Pb to Pd, and thus the description thereof will be omitted.

As shown in FIG. 2, the developing device 3*a* includes a developing container 20 in which the two-component developer (hereinafter also simply referred to as the developer) including the magnetic carrier and the toner is stored, the developing container 20 is partitioned with a partition wall 20*a* into a stirring conveying chamber 21 and a supply conveying chamber 22. In the stirring conveying chamber 21 and the supply conveying chamber 22, a stirring conveying screw 25*a* and a supply conveying screw 25*b* for mixing the toner supplied from the toner container 4*a* (see FIG. 1) with the magnetic carrier and agenting and charging the mixture are respectively and rotatably arranged.

Then, the developer is conveyed in an axial direction (direction perpendicular to the plane of FIG. 2) while being stirred with the stirring conveying screw 25*a* and the supply conveying screw 25*b*, and is circulated between the stirring conveying chamber 21 and the supply conveying chamber 22 through unillustrated developer passages which are formed in both end portions of the partition wall 20*a*. In other words, the stirring conveying chamber 21, the supply conveying chamber 22 and the developer passages form the circulation path of the developer within the developing container 20.

The developing container 20 is extended obliquely upward to the right in FIG. 2, and a developing roller 31 is arranged obliquely upward to the right with respect to the supply conveying screw 25*b* within the developing container 20. Then, part of the outer circumferential surface of the developing roller 31 is exposed from the opening portion 20*b* of the developing container 20 and is opposite the photosensitive drum 1*a*. The developing roller 31 is rotated in the counterclockwise direction of FIG. 2.

The developing roller 31 is formed with: a cylindrical developing sleeve which is rotated in the counterclockwise direction of FIG. 2; and a magnet (not shown) which is fixed within the developing sleeve and which has a plurality of magnetic poles. Although here, the developing sleeve whose surface is knurled is used, a developing sleeve in which a large number of convex shapes (dimples) are formed in its surface, a developing sleeve whose surface is subjected to blast processing, a developing sleeve whose surface is subjected to blast processing in addition to knurling and the formation of convex shapes or a developing sleeve on which plating processing is performed can be used.

A regulation blade 27 is attached to the developing container 20 along the longitudinal direction (direction perpendicular to the plane of FIG. 2) of the developing roller 31. Between the tip end portion of the regulation blade 27 and the surface of the developing roller 31, a slight gap is formed.

The development voltage formed with a direct-current voltage Vs1v (DC) (hereinafter also referred to as Vdc) and an alternating-current voltage Vs1v (AC) is applied to the developing roller 31 with a high-voltage generation circuit 43 (see FIG. 3).

Figure 3:
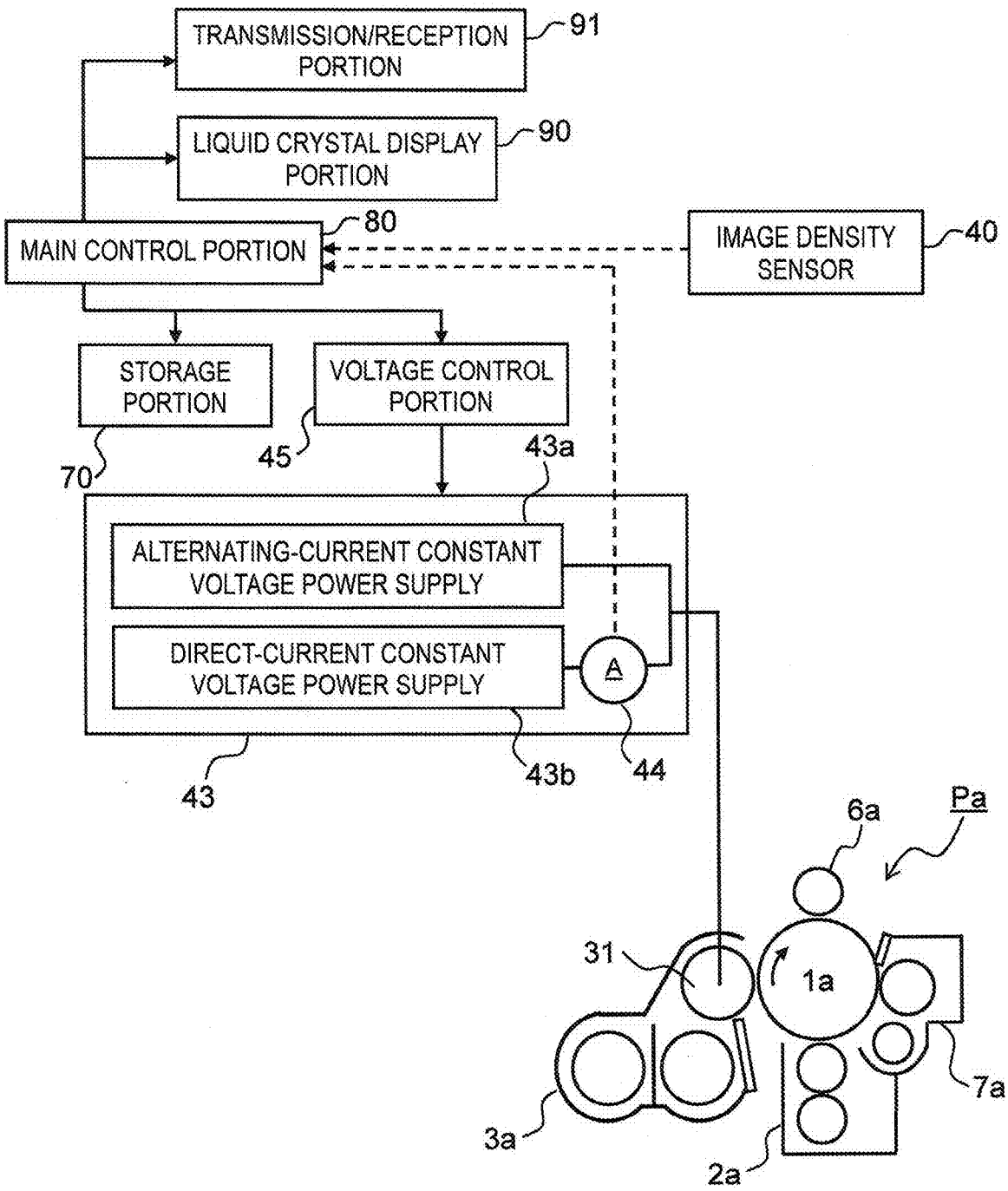
FIG. 3 is a partial enlarged view in the vicinity of an image forming portion which includes the control path of the developing device.

FIG. 3 is a partial enlarged view in the vicinity of the image forming portion Pa which includes the control path of the developing device 3*a*. Although in the following description, the configuration of the image forming portion Pa and the control path of the developing device 3*a* are discussed, the same is true for the configurations of the image forming portions Pb to Pd and the control paths of the developing devices 3*b* to 3*d*, and thus the description thereof will be omitted.

The developing roller 31 is connected to the high-voltage generation circuit 43 that generates an oscillation voltage in which the direct-current voltage and the alternating-current voltage are superimposed on each other. The high-voltage generation circuit 43 includes an alternating-current constant voltage power supply 43*a* and a direct-current constant voltage power supply 43*b*. The alternating-current constant voltage power supply 43*a* outputs a sinusoidal alternating-current voltage generated from a low voltage direct-current voltage which is modulated with a step-up transformer (not shown) so as to be pulse-shaped. The direct-current constant voltage power supply 43*b* outputs a direct-current voltage obtained by rectifying the sinusoidal alternating-current voltage generated from the low voltage direct-current voltage which is modulated with the step-up transformer so as to be pulse-shaped.

At the time of image formation, the high-voltage generation circuit 43 outputs, from the alternating-current constant voltage power supply 43*a* and the direct-current constant voltage power supply 43*b*, the development voltage in which the alternating-current voltage is superimposed on the direct-current voltage. A current detection portion 44 detects a direct current value which flows between the developing roller 31 and the photosensitive drum 1*a*.

The control system of the image forming apparatus 100 will then be described with reference to FIG. 3. In the image forming apparatus 100, the main control portion 80 is provided which is formed with a CPU and the like. The main control portion 80 is connected to a storage portion 70 which is formed with a ROM, a RAM and the like. The main control portion 80 controls, based on control programs and control data stored in the storage portion 70, the individual portions of the image forming apparatus 100 (the charging devices 2*a* to 2*d*, the exposure device 5, the developing devices 3*a* to 3*d*, the primary transfer rollers 6*a* to 6*d*, the cleaning devices 7*a* to 7*d*, the fixing portion 13, the high-voltage generation circuit 43, the current detection portion 44, a voltage control portion 45 and the like).

The voltage control portion 45 controls the high-voltage generation circuit 43. The voltage control portion 45 may be formed with the control programs stored in the storage portion 70.

A liquid crystal display portion 90 and a transmission/reception portion 91 are connected to the main control portion 80. The liquid crystal display portion 90 functions as a touch panel for performing various types of settings of the image forming apparatus 100 by a user, and displays the state of the image forming apparatus 100, the status of image formation, the number of printed sheets and the like. The transmission/reception portion 91 uses a telephone line or an Internet line so as to communicate with the outside.

The image forming apparatus 100 of the present disclosure can perform a development ghost prediction mode in which based on a development current and the amount of development of the toner, the amount of charge of the toner is measured, in which a carrier resistance is calculated from a carrier current amount that is the direct-current component of the development current when the amount of development of the toner is 0 [mg/cm$^2$] and in which the level of occurrence of development ghost is predicted based on the amount of charge of the toner and the carrier resistance.

(Development Ghost Prediction Mode)

Although in the development ghost prediction mode, the occurrence of the development ghost is predicted based on the amount of charge of the toner and the actual measurement value of the carrier resistance, and thus the accuracy thereof is high, when the development ghost prediction mode is frequently performed, the efficiency of image formation in the image forming apparatus 100 is lowered. On the other hand, when a performance interval is excessively increased, in the meantime, changes in the amount of charge of the toner and the carrier resistance are produced, with the result that image quality may be degraded. Hence, the development ghost prediction mode needs to be performed at appropriate intervals.

Hence, in the present disclosure, as a method of predicting the level of occurrence of the development ghost, attention is focused on the development current of a non-image portion. Specifically, the development current of the non-image portion (paper interval) at the time of normal printing is acquired as a carrier current, and thus the level of occurrence of the development ghost is predicted from the carrier current. The development current of the non-image portion in the present specification refers to a current flowing through the developing rollers 31 when the non-image portions (margin portions) of the photosensitive drums 1*a* to 1*d* are opposite the developing rollers 31 at the time of image formation.

In the non-image portion at the time of printing, a voltage (development reverse voltage) Vdc in a direction (V0>Vdc) in which the toners are attracted from the photosensitive drums 1*a* to 1*d* to the side of the developing rollers 31 is applied to the developing rollers 31. This voltage is used for reducing the adherence of the toners to the non-exposure portions (white background portions) of the photosensitive drums 1*a* to 1*d*, and thus the toners are prevented from being actively moved from the photosensitive drums 1*a* to 1*d* to the developing rollers 31. Hence, only a small amount of current flows by the movement of the toners, and thus most of the current which flows serves as the carrier current.

However, as the amount of charge of the toner is lowered, a larger amount of toner is moved to the side of the developing roller 31. Here, a toner layer formed on the developing roller 31 serves as a resistance layer, and thus the development current is lowered. Hence, a change in the development current of the non-image portion is monitored, and thus it is possible to predict whether or not the development ghost occurs. When the amount of change in the direct-current component of the development current exceeds a predetermined value, the development ghost prediction mode is performed, and thus the level of occurrence of the development ghost is checked.

(Development Ghost Measurement Mode)

Since the development ghost can be measured, a development ghost measurement mode is performed so as to actually measure the level of occurrence of the development ghost, and thus the measurement value and a prediction value are compared with each other. Then, based on the result of the comparison, a prediction method (prediction formula) in the development ghost prediction mode is corrected, and thus it is possible to perform a more accurate prediction.

In the method of measuring the development ghost, a high-density image (solid image) is developed over a time corresponding to one or more revolutions of the developing roller 31, thereafter a half-tone image is printed and at least one of the image density of the half-tone image and the development current is acquired. Then, a low-density image is developed over a time corresponding to one or more revolutions of the developing rollers 31, thereafter a half-tone image is printed and at least one of the image density of the half-tone image and the development current is acquired. Since a difference between the image densities of these two half-tone images (the same latent image condition) results in a difference between image densities in the development ghost, the acquired image density difference (or the development current difference) and the prediction value in the development ghost prediction mode are compared with each other, and thus the prediction formula is corrected. In order to enhance the accuracy of the prediction, it is preferable to determine a difference from both the image density difference and the development current difference.

The development ghost is affected by a decrease in the carrier resistance and a decrease in the amount of charge of the toner caused by duration. Although a decrease in the carrier resistance acts to improve the development ghost, a decrease in the amount of charge of the toner acts to worsen the development ghost. Hence, depending on the specifications of the image forming apparatus 100, the status of use by the user and the like, the level of occurrence of the development ghost is changed differently. Since the measurement of the development ghost requires the consumption of the toner and the measurement time, the measurement of the development ghost cannot be frequently performed. Hence, a decrease in the carrier resistance and a decrease in the amount of charge of the toner are considered in terms of chronological changes, and thus the optimal timing of the performance of the development ghost measurement mode is determined on condition that the carrier resistance and the amount of charge of the toner are not significantly changed.

Figure 4:
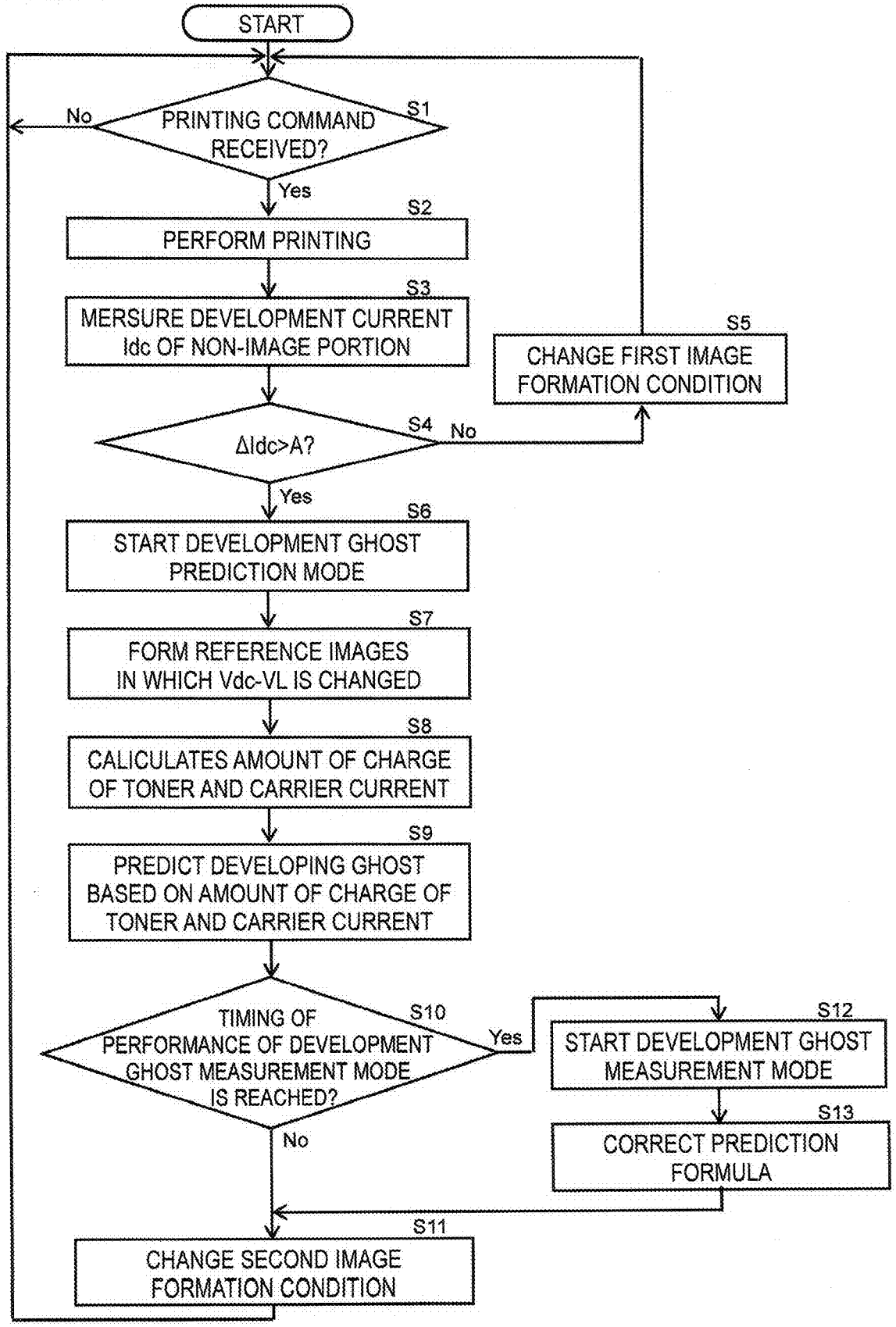
FIG. 4 is a flowchart showing an example of control of a development ghost prediction mode in the image forming apparatus of the present embodiment.

Specifically, for example, when the cumulative number of printed sheets reaches a predetermined number of sheets (for example, 100 thousand sheets) or when the change of a first image formation condition which will be described later and which is shown in FIG. 4 is performed a predetermined number of times (for example, 20 times), the development ghost measurement mode is performed.

(Change of Image Formation Conditions)

Image formation conditions are changed according to the level of occurrence of the development ghost and the cause of occurrence thereof which are estimated from the development ghost prediction mode described above. Specifically, when the amounts of charge of the toners are low, for example, the concentrations of the toners within the developing devices 3*a* to 3*d* are set low, and thus the amounts of charge of the toners are restored. When the carrier current is low (the carrier resistance is high), Vpp of the alternating-current component of the development voltage is increased. When the contamination of the sleeves of the developing rollers 31 progresses, a potential difference (hereinafter referred to as a fogging removal potential difference) V0−Vdc between the surface potentials V0 of the photosensitive drums 1*a* to 1*d* and the direct-current component Vdc of the development voltage is reduced. In this way, it is possible to achieve a development ghost measure in which an image failure is unlikely to occur.

FIG. 4 is a flowchart showing an example of control of the development ghost prediction mode in the image forming apparatus 100 of the present embodiment. The procedure of the performance of the development ghost prediction mode will be described in detail along the steps of FIG. 4 with reference to FIGS. 1 to 3 and FIG. 5 to be described later as necessary.

In FIG. 4, the image forming apparatus 100 is set to a normal printing mode, and the main control portion 80 determines whether or not a printing command is received (step S1). When the printing command is received (yes in step S1), printing is performed by a normal image formation operation (step S2). Then, the direct-current component Idc of the development current of the non-image portion at the time of printing is measured (step S3). The direct-current component Idc of the development current which is measured is transmitted to the main control portion 80.

Then, the main control portion 80 determines whether or not the amount of change ΔIdc in the direct-current component Idc of the transmitted development current from a time when the direct-current component Idc is previously measured exceeds a predetermined value A (here, 0.05 μA) (step S4). When ΔIdc≤A (no in step S4), based on the direct-current component Idc of the development current, the first image formation condition is changed (step S5). As the first image formation condition which is changed, the fogging removal potential difference V0−Vdc can be mentioned. Thereafter, the process is returned to step S1, and a standby state for the printing command is continued. Steps S1 to S5 can be regarded as the control of prediction of the level of occurrence of the development ghost in the normal printing mode.

When ΔIdc>A (yes in step S4), the development ghost prediction mode is started (step S6). Specifically, the surfaces of the photosensitive drums 1*a* to 1*d* are charged with the charging devices 2*a* to 2*d*, and thereafter the electrostatic latent images of the reference images are formed with the exposure device 5 on the photosensitive drums 1*a* to 1*d*. Then, with the high-voltage generation circuit 43, the direct-current component Vdc of the development voltage which is applied to the developing rollers 31 is changed so as to develop the electrostatic latent images into toner images, and thus a plurality of reference images in which a development potential difference (Vdc−VL) is changed are formed on the photosensitive drums 1*a* to 1*d* (step S7). Here, VL refers to the exposure portion potential of the photosensitive drums 1*a* to 1*d*. At the same time, with the current detection portion 44, the direct-current component of the development current flowing through the developing rollers 31 is detected.

Then, a predetermined primary transfer voltage is applied to the primary transfer rollers 6*a* to 6*d* so as to transfer the reference images on the intermediate transfer belt 8. Then, with the image density sensor 40, the densities of the individual reference images are detected. The main control portion 80 calculates the amounts of charge of the toners and the carrier current based on the development current and the densities of the reference images (the amounts of development of the toners) which are detected (step S8).

Figure 5:
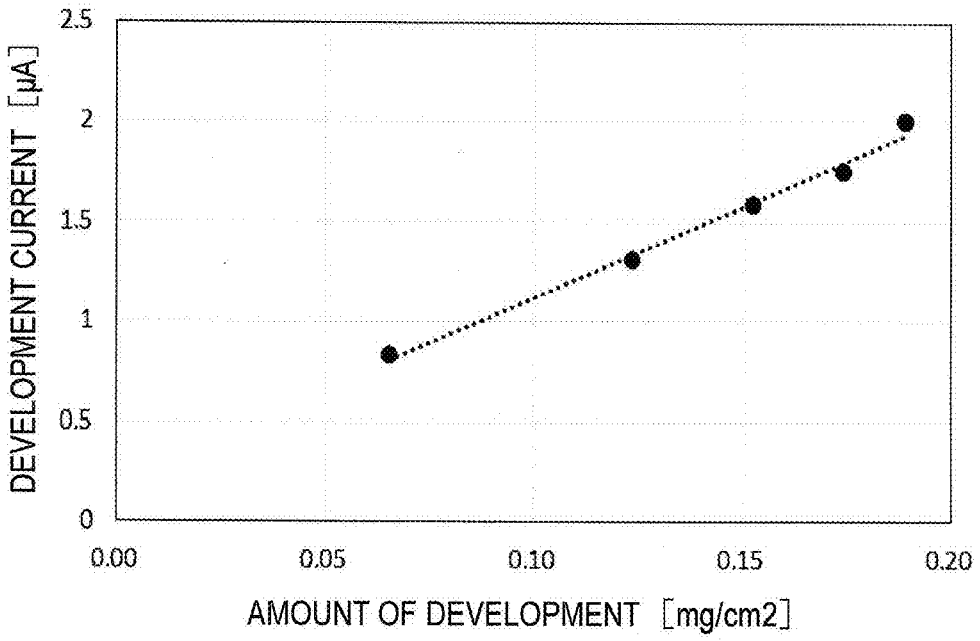
FIG. 5 is a graph showing a relationship between the amount of development of a toner and a development current when reference images whose development potential differences are different are formed.

FIG. 5 is a graph showing a relationship between the amount of development of the toner and the development current when the reference images whose development potential differences (Vdc−VL) are different are formed. The value of the y intercept of an approximate straight line (y=9.1196x+0.2093) indicated by a dotted line in FIG. 5 is 0.21 [μA]. This current value is the carrier current when the amount of development of the toner is 0 [mg/cm$^2$]. The amount of charge of the toner can be determined from the slope of the approximate straight line. In an actual calculation, it is necessary to calculate the amount of current [μA/cm$^2$] per unit area by dividing the development current by a measurement area. When the image density is measured at a plurality of parts of the one reference image, and the average value of the individual measurement values is used, an error is reduced.

Figure 6:
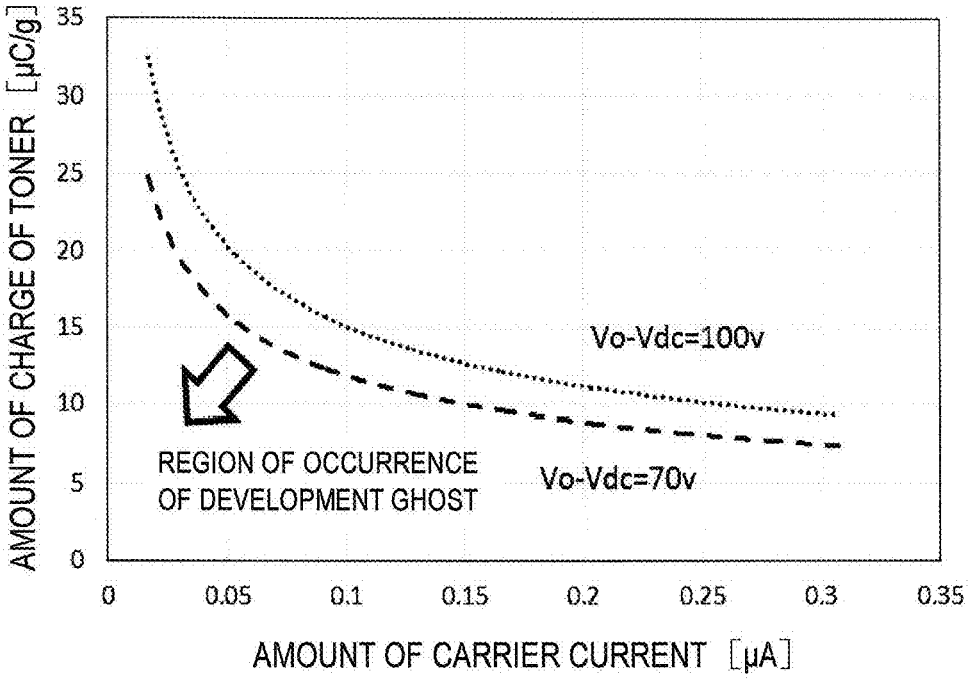
FIG. 6 is a graph showing a relationship among a carrier current, the amount of charge of the toner and the occurrence of development ghost.

Then, with reference back to FIG. 4, the main control portion 80 estimates the level of occurrence of the development ghost and the cause of occurrence thereof based on the amount of charge of the toner and the carrier current (step S9). FIG. 6 is a graph showing a relationship among the carrier current, the amount of charge of the toner and the occurrence of the development ghost. Since the development ghost occurs when the development current and the amount of charge of the toner are equal to or less than constant values, the lower side of a curve indicated by a dotted line in FIG. 6 is the region of occurrence of the development ghost. As a point is moved away from the curve in FIG. 6 toward the lower side, the occurrence of the development ghost is more remarkable, with the result that when the amount of charge of the toner and the carrier current are found, the level of occurrence of the development ghost and the cause of occurrence thereof can be estimated.

Then, the main control portion 80 determines whether or not the timing of the performance of the development ghost measurement mode is reached (step S10). When the timing of the performance of the development ghost measurement mode is not reached (no in step S10), the main control portion 80 changes a second image formation condition based on the results of the estimation of the level of occurrence of the development ghost and the cause of occurrence thereof (step S11), and completes the development ghost prediction mode. As the second image formation condition which is changed, the concentrations of the toners in the developers within the developing devices 3*a* to 3*d*, the peak-to-peak voltage value Vpp of the alternating-current component of the development voltage and the fogging removal potential difference V0−Vdc can be mentioned.

Specifically, when the amount of charge of the toner is low, as the level of occurrence of the development ghost is increased, the concentration of the toner is lowered, with the result that the amount of charge of the toner is increased. When the carrier resistance is high (the carrier current is low), Vpp of the alternating-current component of the development voltage is lowered.

Alternatively, as shown in FIG. 6, the curve indicating the region of occurrence of the development ghost is changed by the value of V0−Vdc, and the curve when V0−Vdc=70 [V] is moved downward to the left as compared with the curve when V0−Vdc=100 [V]. Hence, as the level of occurrence of the development ghost is increased, V0−Vdc is decreased, and thus it is possible to reduce the occurrence of the development ghost.

When the timing of the performance of the development ghost measurement mode is reached (yes in step S10), the main control portion 80 starts the development ghost measurement mode (step S12). Then, the measurement value acquired in the development ghost measurement mode and the prediction value acquired in the development ghost prediction mode are compared with each other, and thus the prediction formula (the curve of FIG. 6) for the development ghost is corrected (step S13). Thereafter, the second image formation condition is changed based on the measurement value (step S11), and the development ghost prediction mode is completed.

As described above, the development ghost prediction mode is performed in which the amount of charge of the toner and the carrier current are used to estimate the level of occurrence of the development ghost and the cause of occurrence thereof, and thus it is possible to accurately estimate the level of occurrence of the development ghost and the cause of occurrence thereof and to thereby set appropriate image formation conditions under which the development ghost is prevented from occurring. Hence, it is possible to effectively reduce an image failure caused by the development ghost.

The current value of the direct-current component of the development current of the non-image portion at the time of image formation is used to predict the level of occurrence of the development ghost, and only when it is estimated that the level of occurrence of the development ghost is high, the development ghost prediction mode is performed, with the result that it is possible to perform the development ghost prediction mode with appropriate timing. Hence, it is possible to effectively reduce an image failure caused by the occurrence of the development ghost while minimizing increases in the consumed toner and the consumed power and a decrease in the efficiency of image formation which result from the unnecessary performance of the development ghost prediction mode.

When the development ghost prediction mode is not performed, the direct-current component Vdc of the development voltage is changed while the normal printing mode is being continued, and thus it is possible to take an immediately effective measure for a short-term change in the level of occurrence of the development ghost. On the other hand, when the development ghost prediction mode is performed, the concentrations of the toners within the developing devices 3*a* to 3*d*, Vpp of the alternating-current component of the development voltage and the development potential difference V0−Vdc are changed, and thus it is possible to take an effective measure for a long-term change in the level of occurrence of the development ghost.

The present disclosure is not limited to the embodiment described above, and various modifications are possible without departing from the spirit of the present disclosure. For example, although in the embodiment described above, a plurality of measurement patterns whose image densities (printing rates) are different are formed, and the amounts of charge of the toners are measured based on the relationship between the difference of the amounts of development (the difference of the densities) in the individual measurement patterns and the difference of the development currents flowing when the measurement patterns are formed, the method of measuring the amounts of charge of the toners is not limited to the method described above. For example, a method can be used in which the electrostatic latent image of the same measurement pattern is developed into toner images by switching of the frequency of the alternating-current component of the development voltage so as to form two types of measurement patterns and in which the amounts of charge of the toners are measured based on a relationship among the difference of the development currents flowing when the individual measurement patterns are formed, the difference of the amounts of development (the difference of the densities) and the measurement patterns or a method can be used in which the amounts of charge of the toners are measured based on a relationship between the frequency and the difference of the amounts of development (the difference of the densities).

Although in the description of the embodiment discussed above, the color printer as shown in FIG. 1 is used as an example of the image forming apparatus 100, the image forming apparatus 100 is not limited to the color printer, and may be an image forming apparatus such as a monochrome or color copying machine, a digital multifunctional peripheral or a facsimile machine. The effect of the present invention will be described in more detail below using Example.

EXAMPLE

A verification test was performed on an effect of reducing development ghost when the development ghost prediction mode shown in FIG. 4 was performed and the image formation conditions were changed based on the development ghost which was predicted. As the conditions of a testing machine, in the image forming apparatus 100 as shown in FIG. 1, the photosensitive drums 1*a* to 1*d* including amorphous silicon (a-Si) photosensitive layers were used, and settings were made such that non-exposure portion potential V0=270V and that exposure portion potential VL=20V. A drum linear speed (process speed) was set to 55 sheets/min.

In the developing devices 3*a* to 3*d*, the developing rollers 31 were used in which concave portions of 80 rows were formed in a circumferential direction by knurling and whose diameters were 20 mm, and as the regulation blades 27, magnetic material blades formed of stainless steel (SUS430) were used. The amounts of developers conveyed with the developing rollers 31 were set to 250 g/m$^2$. The circumferential speed ratios between the developing rollers 31 and the photosensitive drums 1*a* to 1*d* were set to 1.8 (at an opposite position, trail rotation), and the distances between the developing rollers 31 and the photosensitive drums 1*a* to 1*d* were set to 0.30 mm. As the development voltage, a voltage in which a rectangular alternating-current voltage having a frequency of 4.2 kHz and a duty of 50% was superimposed on a direct-current voltage Vs1v (DC) of 170V was applied to the developing rollers 31.

Two-component developers formed with a positively charged toner having an average particle diameter of 6.8 μm and a ferrite/resin coat carrier having an average particle diameter of 35 μm were used, and the concentrations of the toners were set to 8%.

As a testing method, in a case where the second image condition was changed such that the concentrations of the toners within the developing devices 3*a* to 3*d*, Vpp of the alternating-current component of the development voltage and the development potential difference V0−Vdc were changed according to the level of occurrence of the development ghost (present invention 1), in a case where in addition to the second image formation condition, the first image condition was changed such that the direct-current component Vdc of the development voltage was changed according to the level of occurrence of the development ghost (present invention 2) and in a case where the image conditions were not changed (Comparative Example 1), 220 thousand sheets were durably printed, and the level of occurrence of the development ghost was evaluated.

Figure 7:
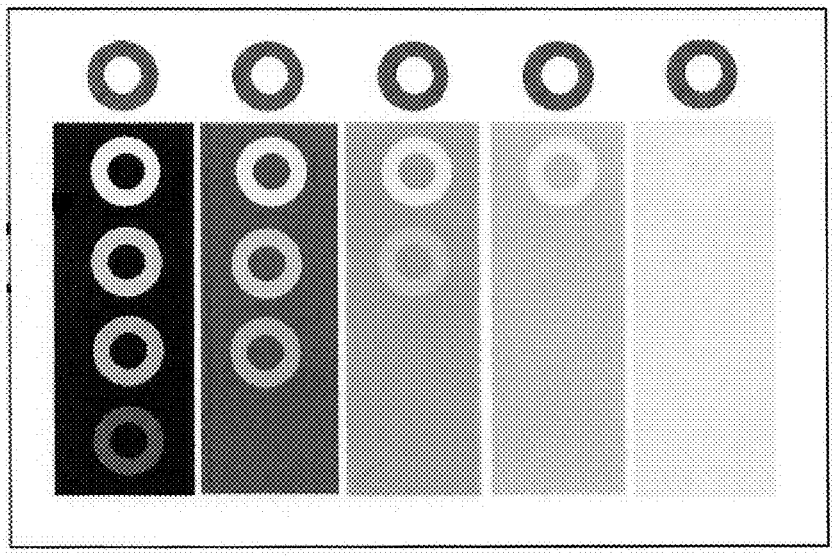
FIG. 7 is a diagram showing a test image which is used when the level of occurrence of the development ghost is evaluated in Example.

The evaluation of the development ghost was a sensory evaluation (visual inspection), and the evaluation was performed by the number of ghosts generated on a test image in which a solid image that was as shown in FIG. 7 and that was ring-shaped was printed and in which thereafter 5%, 10%, 15%, 20% and 25% half images were printed. The number of development ghosts generated was four at the maximum for each of the densities, the total was 4×5=20 pieces and in evaluation criteria, a case where no development ghost was generated was set to level 5, a case where development ghosts were generated but were not noticeable (the number of development ghosts generated was 1 to 5) was set to level 4, a case where development ghosts were generated but were allowable (the number of development ghosts generated was 6 to 10) was set to level 3, a case where development ghosts were generated and were noticeable (the number of development ghosts generated was 11 to 15) was set to level 2 and a case where development ghosts were generated and were significantly noticeable (the number of development ghosts generated was 16 to 20) was set to level 1. The results thereof are shown in FIG. 8.

Figure 8:
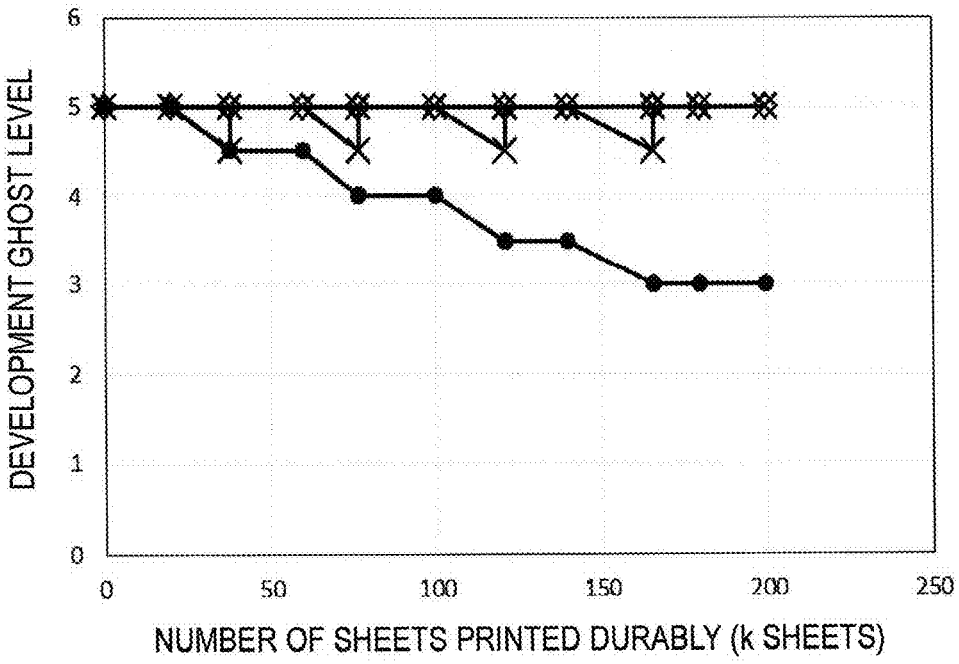
FIG. 8 is a graph showing the progress of development ghost levels when sheets were durably printed in a case where the development ghost prediction mode was performed and where a first image formation condition or a second image formation condition was changed (present invention 1, 2) and in a case where the development ghost prediction mode was performed and where neither the first image formation condition nor the second image formation condition was changed (Comparative Example 1).

As is clear from FIG. 8, in present invention 1 (the data series of x in FIG. 8) in which the second image formation condition was changed according to the level of occurrence of the development ghost, the level of occurrence of the development ghost after 200 thousand sheets were durably printed was level 4.5 at the maximum, and either the development ghosts were not generated or the development ghosts were generated but were not noticeable. In present invention 2 (the data series of ◇ in FIG. 8) in which in addition to the second image formation condition, the first image condition was changed, the level of occurrence of the development ghost after 200 thousand sheets were durably printed was level 5 at the maximum, and no development ghost was generated.

By contrast, in Comparative Example 1 (the data series of ● in FIG. 8) in which the image formation conditions were not changed, the level of occurrence of the development ghost after 200 thousand sheets were durably printed was level 3 at the maximum, and development ghosts were generated but were allowable.

The present disclosure can be utilized for image forming apparatuses of an electrophotographic system. By utilization of the present invention, with the development current, the state of occurrence of the development ghost is accurately predicted, the development ghost prediction mode is performed based on the result of the prediction and thus it is possible to provide an image forming apparatus which can perform a necessary and sufficient development ghost prediction mode corresponding to the level of occurrence of the development ghost.

What is claimed is:

1. An image forming apparatus comprising:

an image forming portion that includes an image carrying member in which a photosensitive layer is formed on a surface, a charging device which charges the image carrying member, an exposure device which exposes the image carrying member charged with the charging device so as to form an electrostatic latent image and a developing device which includes a developer carrying member that is arranged opposite the image carrying member and that carries a developer including a magnetic carrier and a toner and which adheres the toner to the electrostatic latent image formed on the image carrying member so as to form a toner image, a high-voltage generation circuit that applies, to the developer carrying member, a development voltage in which an alternating-current voltage is superimposed on a direct-current voltage;

a current detection portion that detects a direct-current component of a development current which flows when the development voltage is applied to the developer carrying member; and a control portion that controls the image forming portion and the high-voltage generation circuit, wherein the control portion can perform a development ghost prediction mode that includes a step of measuring an amount of charge of the toner within the developing device at a time of non-image formation, a step of measuring, as a carrier current, the direct-current component of the development current when an amount of development of the toner is 0 [mg/cm$^2$] and a step of estimating a level of occurrence of development ghost and a cause of occurrence thereof based on the amount of charge of the toner and the carrier current which are measured.

2. The image forming apparatus according to claim 1, wherein when an amount of change in the direct-current component of the development current from a time when the direct-current component is previously measured is equal to or less than a predetermined value, the control portion does not perform the development ghost prediction mode and changes a first image formation condition.

3. The image forming apparatus according to claim 2, wherein when the amount of change in the direct-current component of the development current from the time when the direct-current component is previously measured is equal to or less than the predetermined value, the control portion decreases, as the first image formation condition, a potential difference V0−Vdc between a non-exposure portion potential V0 of the image carrying member and a direct-current component Vdc of the development voltage.

4. The image forming apparatus according to claim 1, wherein the development ghost prediction mode includes a step of changing a second image formation condition according to the level of occurrence of the development ghost and the cause of occurrence thereof which are estimated.

5. The image forming apparatus according to claim 4, wherein when the amount of charge of the toner is lower than a predetermined value, as the second image formation condition, the control portion lowers a concentration of the toner in the developer within the developing device or decreases a potential difference V0−Vdc between a non-exposure portion potential VO of the image carrying member and a direct-current component Vdc of the development voltage.

6. The image forming apparatus according to claim 4, wherein when the carrier current is lower than a predetermined value, as the second image formation condition, the control portion lowers a peak-to-peak value of an alternating-current component of the development voltage or decreases a potential difference V0−Vdc.

7. The image forming apparatus according to claim 1, wherein when a non-image portion of the image carrying member is opposite at a time of image formation, the control portion detects the direct-current component of the development current which flows through the developer carrying member, and when an amount of change in the detected direct-current component of the development current from a time when the direct-current component is previously measured is larger than a predetermined value, the control portion performs the development ghost prediction mode.

8. The image forming apparatus according to claim 1, wherein the control portion can perform a development ghost measurement mode in which a status of occurrence of the development ghost is measured, and the control portion corrects, based on a result of the measurement of the development ghost in the development ghost measurement mode, a prediction formula for the development ghost in the development ghost prediction mode.

9. The image forming apparatus according to claim 1, comprising:

a density detection device which detects a density of the toner image formed with the developing device, wherein the control portion forms, with the developing device, on the image carrying member, a plurality of reference images whose potential differences Vdc−VL between an exposure portion potential VL of the image carrying member and a direct-current component Vdc of the development voltage are different, and acquires a correlation between the amount of development of the toner calculated from densities of the reference images detected with the density detection device and the direct-current component of the development current detected with the current detection portion when the reference images are formed, and the control portion calculates, from an amount of change in the direct-current component of the development current with respect to the amount of development of the toner, the amount of charge of the toner and the carrier current which is the direct-current component of the development current when the amount of development of the toner is 0 [mg/cm$^2$] so as to estimate the level of occurrence of the development ghost and the cause of occurrence thereof based on the amount of charge of the toner and the carrier current which are calculated.

* * * * *